US005394940A

United States Patent [19]

Durham

[11] Patent Number: 5,394,940

[45] Date of Patent: Mar. 7, 1995

[54] SUCKER ROD GUIDE

[75] Inventor: Robert M. Durham, Lubbock, Tex.

[73] Assignee: Amarillo Pump & Supply Company, Inc., Lubbock, Tex.

[21] Appl. No.: 150,462

[22] Filed: Nov. 10, 1993

[51] Int. Cl.[6] ..... E21B 17/10

[52] U.S. Cl. ..... 166/241.4; 166/378; 156/295; 264/262; 206/443

[58] Field of Search ..... 166/176, 241.2, 241.4, 166/378; 264/262; 403/267, 268; 156/293–295; 206/443

[56] References Cited

U.S. PATENT DOCUMENTS

| | | | |
|---|---|---|---|
| Re. 31,016 | 8/1992 | Oster | 166/176 X |
| 1,460,632 | 7/1923 | Wigle et al. | 166/241.6 |
| 1,738,594 | 12/1929 | Macvicar | 166/241.6 X |
| 1,807,050 | 5/1931 | Stolz | 166/241.6 X |
| 2,166,116 | 7/1939 | Bettis | 166/241.6 |
| 2,781,100 | 2/1957 | Pyle et al. | 166/241.6 X |
| 4,146,060 | 3/1979 | Garrett | 175/325.2 X |
| 4,171,560 | 10/1979 | Garrettt | 264/262 X |
| 4,575,163 | 3/1986 | Sable | 166/241 X |
| 4,668,117 | 5/1987 | Bair | 403/267 X |
| 4,766,663 | 8/1988 | Milam | 156/295 X |
| 4,858,688 | 8/1989 | Edwards | 166/241 |
| 5,115,863 | 5/1992 | Olinger | 166/241 |
| 5,154,867 | 10/1992 | Edwards | 264/148 |
| 5,191,938 | 3/1993 | Sable et al. | 166/378 |

*Primary Examiner*—Roger J. Schoeppel
*Attorney, Agent, or Firm*—Wendell Coffee

[57] ABSTRACT

Rod guides having four axial flutes separating four axial ribs are telescoped over sucker rods for water wells. The bore of the guides have a taper or bell from a tight fitting or snug fitting cylindrical section within the guides toward a bell or flare end. The adhesive fills the annular space between the bell or flare and the sucker rod to form a wedge to attach the guide to the sucker rod. Two guides on each joint of the sucker rod are aligned so that five sucker rods may be formed into a bundle with the guides staggered on different rods of the bundle to prevent interference and so that the rods nest into the flutes of the guides to form a compact bundle before the rods are bundled for shipment.

13 Claims, 2 Drawing Sheets

SUCKER ROD GUIDE

BACKGROUND OF THE INVENTION

1. Field of the Invention

This invention relates to wells pumped by reciprocating sucker rods and more particularly to shallow wells, principally water wells. Water well mechanics have ordinary skill in this art.

2. Description of Related Arts

Before this invention the applicant is unaware of sucker rod guides for water wells. Rod guides are known in the oil-well art. Oil wells are deeper than water wells. Usually, oil wells are at least 2,000 feet, and some over 10,000 feet. Water wells are normally shallow and when pumped, water wells with sucker rods are usually over 35 feet and seldom over 750 feet. Often windmills form the motor power for reciprocating sucker rods to pump water wells.

In recent years composite materials often referred to as fiber-reinforced plastics have been used for sucker rods.

Composite sucker rods are known in the oil well art and have many desirable qualities. However, composite rods tend to be more flexible than wooden or steel sucker rods. Therefore the composite rod is more likely to rub upon the surrounding eduction tube. Also, normally the composite material will result in greater wear than metal or wooden sucker rods, when they do rub.

Customarily oil wells use steel sucker rods, whereas water wells customarily use wooden sucker rods.

Before the use of composite sucker rods, rod guides were used with oil wells because of their great depth but were virtually unknown for water wells because of the shallow depth and the use of wood for sucker rod material.

Normally the oil well sucker rod guides are elongated about an axis and are fluted to form ribs or bars extending from the central body. The guides were sometimes molded upon the rod. (See OLINGER U.S. Pat. No. 5,115,863). Some of the guides had axial slots therein such as the EDWARDS ET AL U.S. Pat. Nos. 4,858,688 and 5,154,867 as well as OLINGER U.S. Pat. No. 5,115,863. Others had "snap on type openings" such as SABLE U.S. Pat. No. 4,575,163 and SABLE ET AL U.S. Pat. No. 5,191,938.

Also, some of the rod guides were mounted for movement upon the sucker rod such as OSTER Re.31,016. The OSTER Patent discloses an anti-friction surface having a short polish rod which is threaded on each end. The rod guide is loose upon the polished rod and telescopes over one end before the polished rod is threaded into a box fitting at either end.

SUMMARY OF THE INVENTION (1) Progressive Contribution to the Art

This application discloses a fluted rod guide adhered to a composite sucker rod for water wells. The rod guide is telescoped over one end and onto the sucker rod before an end fitting is attached. The guide could not be telescoped over the rod after the end fittings are attached. To obtain a permanent attachment to the sucker rod the internal bore of the rod guide has a central cylindrical section which forms a snug fit to the sucker rod. On one end of the cylindrical section is a scraper or shoulder to scrape or move the excess fluid adhesive along the sucker rod. The bore from the ends of the cylindrical section to the ends of the guide are tapered or flared. Adhesive is placed between the taper and rod. When set, the adhesive forms a wedge.

For commercial use in water wells it is desired that the sucker rods, in about 20 foot sections be completely assembled with the guides and end fittings thereon when shipped. It is desirable to ship the sucker rods in a bundle of 5 sucker rods (assembled length about 100 feet) It is desirable to use 4 ribs or bars on each guide extending from the sucker rod and align the ribs so that the sucker rods may be bundled around the staggered guides. Normally one guide will be placed near the end of each sucker rod and one guide about mid-point of each sucker rod.

(2) Objects of this Invention

An object of this invention is to pump water from wells within the earth.

Other objects of this invention are to prevent wear and friction of the sucker rod upon the eduction tube within which it operates.

Further objects are to achieve the above with devices that are sturdy, compact, durable, lightweight, simple, safe, efficient, versatile, ecologically compatible, energy conserving, and reliable, yet inexpensive and easy to manufacture, ship, store, install, and maintain.

Other objects are to achieve the above with a method that is rapid, versatile, ecologically compatible, energy conserving, efficient, and inexpensive, and does not require highly skilled people to install, and maintain.

The specific nature of the invention, as well as other objects, uses, and advantages thereof, will clearly appear from the following description and from the accompanying drawings, the different views of which are not necessarily scale drawings.

Figure 1:
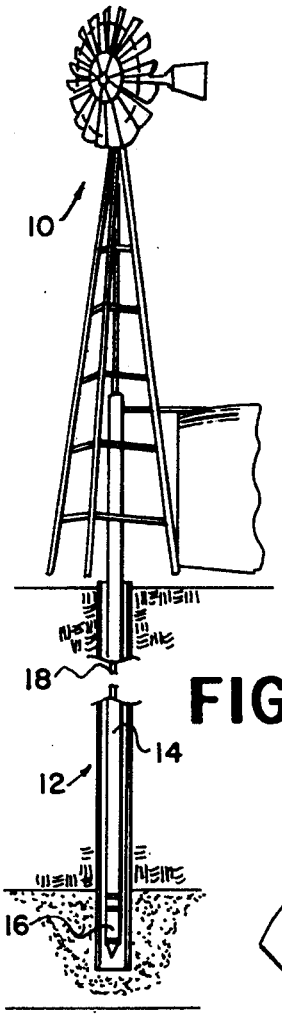
FIG. 1. is a schematic representation of a water well according to this invention.
Figure 2:
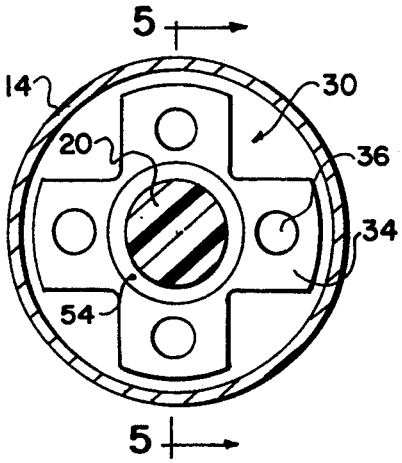
FIG. 2. is a cross-sectional view of a sucker rod in an eduction tube showing a rod guide according to this invention.

As an aid to correlating the terms of the claims to the exemplary drawing(s), the following catalog of elements and steps is provided:

10 windmill
12 well
14 eduction tube
16 pump
18 sucker rod string
20 joint
20-c center rod
20-m mid out rod
20-b bottom out rod
22 pin fitting
24 fitting
26 bundle 27 band around bundle
28 sucker rod end
30 guide
32 flutes
34 guide bars
36 circular aperture
38 bore
40 flare end
42 guide end
44 cylindrical section
46 shoulder end
48 taper end
49 shoulder taper
50 flare
52 taper
54 adhesive
55 jig
56 bar, notches
58 plate
60 dowel

DESCRIPTION OF THE PREFERRED EMBODIMENT

Referring to the drawings there may be seen a representation of water well 12. The water well is shown powered by windmill 10 which is mounted over the well 12. The well will include eduction tube 14 and pump 16 located within an aquifer.

The windmill 10 forms a power means for reciprocating sucker rod string 18 within the tube 14. Other means of reciprocating the string could be used.

Joints 20 of the sucker rod string 18 will have male or pin fitting 22 upon one end of the sucker rod and female or box end fitting 24 upon the other end to couple the individual joints into the string 18. In normal practice the joints 20 within the string will be oriented with the box end 24 on the upper end of each joint 20 and the pin end 22 on the lower end 28 of each joint 20.

Those with ordinary skill in the water well arts will understand that the description to this point is old and well known in the art.

The sucker rods are normally one of two standard sizes. Either $\frac{3}{4}''$ (0.75″) or $\frac{5}{8}''$ (0.625″). The eduction tubes are normally 2″ inside diameter or larger.

Illustrated guide 30 are for a $\frac{3}{4}''$ sucker rod. The guide 30 will be tubular with a fluted exterior. i.e., the outside surface will have flutes 32 in them thus forming axial ribs or guide bars 34 on the outside. To form a bundle of 5 joints 20 into a bundle 26 it is desired that each guide have four flutes 32 and four bars 34. The bars will extend outward an equal distance from the axis of bore 38 through the body which will be often referred to as the guide axis. For proper operation allowing for a certain imperfection in the pipes, the outside of the guide will be 1.875 inch at its largest point.

The guide 30 is designed to be molded and for purposes of being molded the outside of the guide will be tapered from one end to the other so that the smaller end of the guide will have a maximum outside diameter distance from the tip of one bar 34 to the tip of the opposing bar of 1.771″. I.e. the smaller end of the guide 30 will have a diameter of 0.070″ less than the larger end. Generally the thickness of the bars will be less than 0.70″.

For conventional good practice in molding the bars 34 and also to provide additional passages of fluid axially along the guide, each of the bars will have circular aperture 36 extending through them. The aperture will be parallel to the guide axis. The diameter of the aperture will be about 0.30″.

Bore 38 through the guide 30 will have cylindrical section 44 about half way between shoulder guide end or bell end or flare end 40 and taper guide end or guide end 42. This cylindrical section 44 will be relatively short, normally less than half an inch. The section 44 may be infinitesimally short, however, it is useful to describe it as finite. The cylindrical section will have a diameter only slightly larger than the diameter of the rod. i.e. it will have a diameter of 0.002″ to 0.005″ greater than the maximum tolerance diameter of the rod. Therefore it may be seen that the cylindrical section 44 will form a snug fit with the rod 20 when telescoped thereon. The cylindrical section 44 will have shoulder end 46 and taper end 48. It will be understood that ends 46 and 48 are section ends.

The shoulder at 46 will be about 0.010″ measured along a diametric line. I.e., if the diameter of the cylindrical section 44 were 0.752″ then the diameter of the bore 38 on the other side of the shoulder is 0.772″. The bore tapers and flares from the shoulder 46 to the flare end 40. This is an expanding taper, meaning that the bore is larger at the bell or flare end 40 than at the shoulder end 46. Likewise the bore 38 is tapered from the taper end 48 to the guide end 42 with an expanding taper.

Shoulder taper 49 and bell or flare 50 extending from the shoulder end 46 to the flare end 40 has two slopes. The slope of shoulder of taper 49 next to the shoulder end 46 has a smaller angle of taper than the flare 50 adjacent to the guide end 40.

Taper 52 from taper end 48 to guide end 42 has only a single slope. The slope angle of taper 52 is equal or about equal to the angle of shoulder taper 49 adjacent to the shoulder end 46.

To assemble the sucker rod with the guides 30 and the end fittings 22 and 24, the joints are first cut to length. Normally they are cut to about 20 feet. Then each of a first guide 30 is telescoped over sucker rod end. If the guide is telescoped over the pin end 28 the flare end 40 of the guide will be the leading end when it is placed on the sucker rod. On the other hand, if the guide is telescoped over the end upon which the box fitting 24 will be placed, then the guide end 42 would be the leading end. In either event it will be understood that the flare end 40 will be closer to the box end fitting 24 than the pin end fitting 22. If adhesive 54 is in place within the taper 49 and flare 50 it will form a wedge. In rough handling the guides 30 will be more likely to be forced or knocked upward which will be toward the box end 24 than downward toward the pin end 22. Therefore with the wedge of adhesive within the annular space between the flare 50 and the sucker rod 20 there will be a wedging or blocking action. Therefore for movement in the direction described the guide will be secured to the sucker rod by the wedging action as well as being adhered to the sucker rod by the adhesive. The desired adhesive for attaching the guide to the sucker rod will be a epoxy resin with a relatively quick curing catalyst therein.

After two guides are placed upon each sucker rod a pin fitting 22 will be placed upon rod end 28 and a box fitting 24 will be placed upon the other rod end. They will be attached in conventional manner which will include setting an adhesive epoxy resin in a portable oven. However, inasmuch as the attachment of pin and box fittings 22 and 24 to composite rods 20 is well known to the art, that process will not be further described here.

Figure 6:
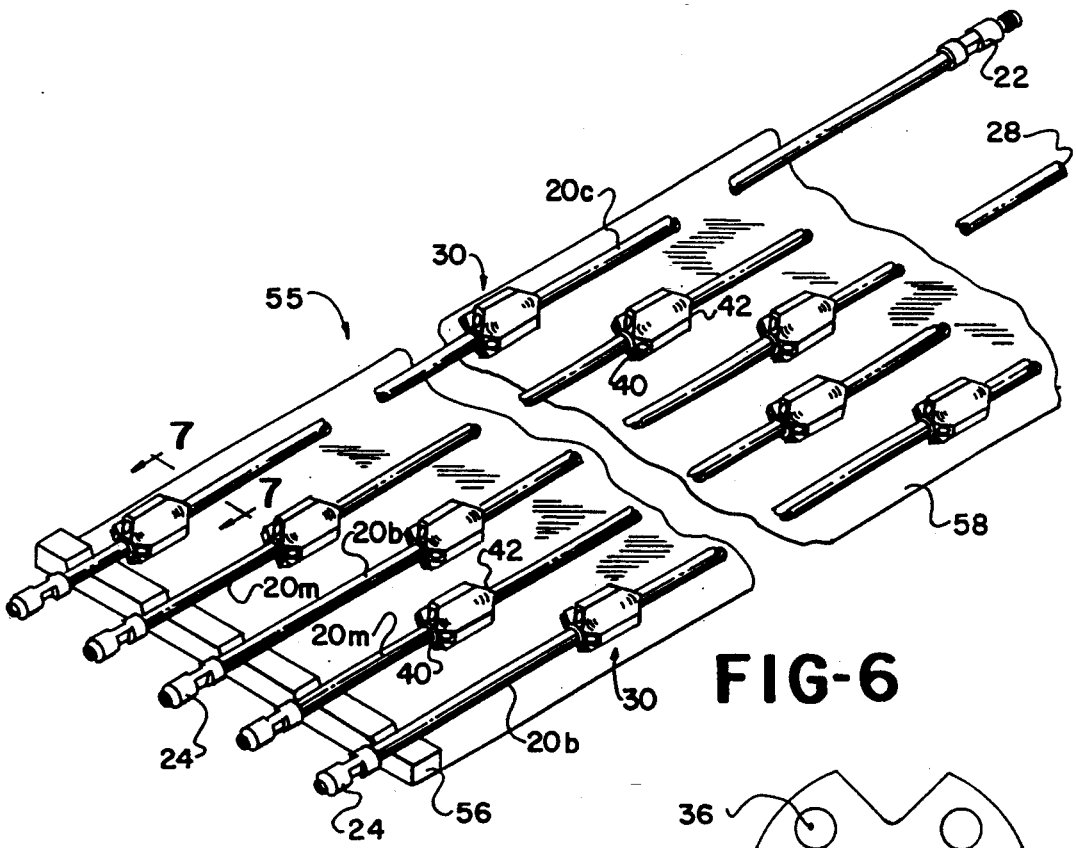
FIG. 6. is a perspective view of a jig for attaching and aligning guides on sucker rods.
Figure 7:
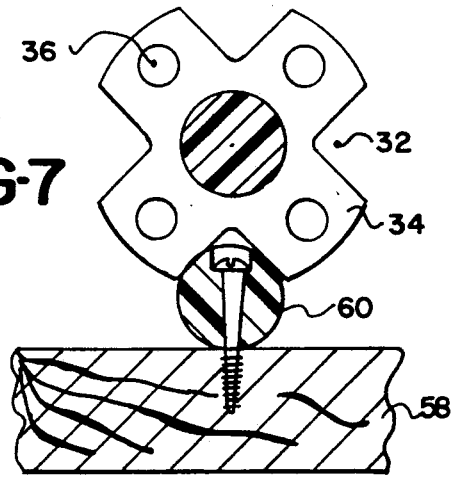
FIG. 7. is a sectional view taken on line 7—7 of FIG. 6.
Figure 5:
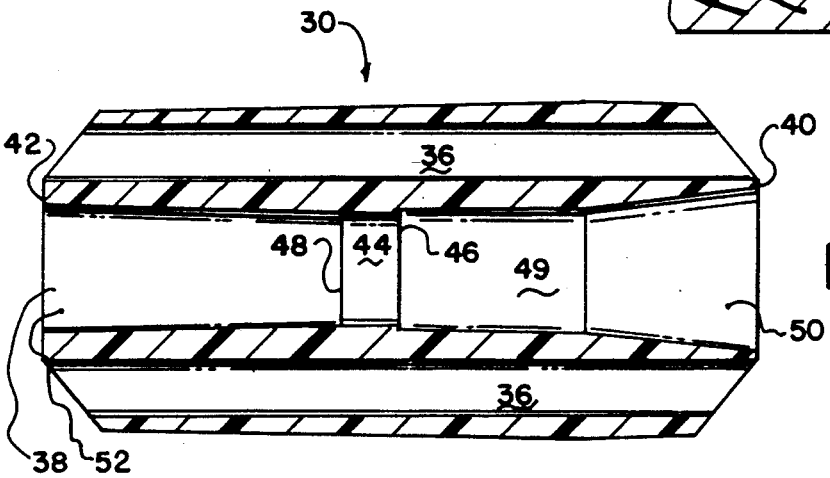
FIG. 5. is a longitudinal sectional view of a rod guide taken substantially along line 5—5 of FIG. 2.

After the end fittings 22 and 24 have been fixed to the rods, the rods will be placed upon jig 55 as seen in FIG. 6. The jig will have bar 56 at one end with a series of at least five notches to receive a series of five joints 20. Namely, the joints will be identified as center joint 20-*c*, two mid-joints 20-*m*, and two bottom joints 20-*b*. The box end fittings 24 will be placed near the notches of bar 56. Near the pin fittings 22 will be a clamp to clamp the rods 20 in place on the jig 55. The clamp is not shown for clarity in the drawing.

The jig 55 includes wooden plate 58. The plate will have a series of guide dowels 60 attached thereto. Along the joint 20-*c* a guide dowel 60 will be placed adjacent to the bar 34. Another guide dowel 60 will be placed along the joint 20-*c* about halfway between fitting 24 and 22. Guide dowel 60 will be placed upon the board 58 spaced adjacent but toward the end fitting 22 from the dowels beneath the joint 20-*m*. Likewise dowel 60 will be placed adjacent to the dowels under joints 20-*b* but also spaced toward the end fitting 22.

Referring to the FIG. 6, although the dowels 60 are not shown it will be understood that there is a dowel underneath each of the guides 30 in the position that the guides are shown in FIG. 6.

With the rods 20 clamped to the jig 54 each of the guides 30 will be spaced from their corresponding dowels 60 toward the pin fittings 22. At that time and with the guides positioned in such a manner, thick viscous adhesive will be brushed or wiped upon each of the joints 20 over the each of the dowels 60 or if not directly over the dowels 60 between the dowels 60 and the guide 30. The guides are then moved toward the box ends 24 in rotational manner. As the guides are moved over the adhesive the adhesive will be distributed around the rod and will fill the annular space that exists between the shoulder taper 49 and flare 50 and the rod 20. The shoulder 46 will scrape all but a thin film of no more than 0.0025 inches thick between the cylindrical section 44 and the joint 20. However, the annular space, being that space between the shoulder taper 49 and the flare 50, will be filled with adhesive. Guides are advanced until they are over their respective dowels 60 and then they are lowered on them with the dowel 60 fitting within one of the flutes 32 of each of the guides.

Figure 4:
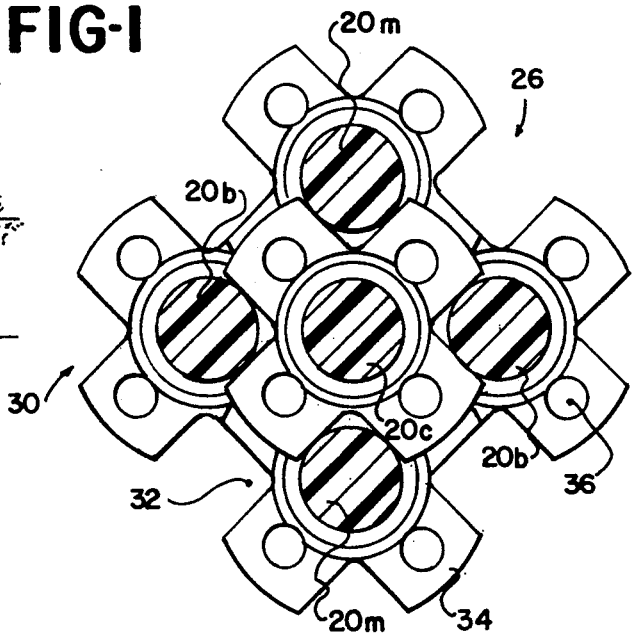
FIG. 4. is a cross-sectional view taken substantially on line 4—4 of FIG. 3 of the bundle of sucker rods with guides thereon.
Figure 3:
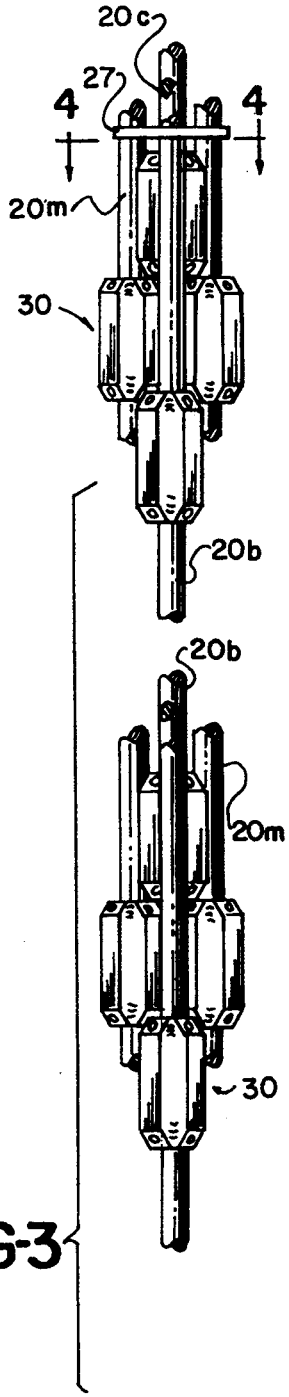
FIG. 3. is a side elevational view, foreshortened, of a bundle of sucker rods with guides according to this invention.

Analysis of the procedure described will show that the guides 30 upon each rod 20 will be rotationally aligned. I.e. the flutes 32 will be aligned. Also it will be seen that after the adhesive is set the guide 30 will be upon the different rods 20 in the position as seen in FIG. 3 and FIG. 4. I.e. the guides may be assembled into the bundle and strapped by strap 27 securely within the bundle and that the guides upon rods 20-*m* will not interfere with the guides on 20-*b*, nor with the guides upon 20-*c*. Also it may be seen that on the set of guides adjacent to the box end 24 are of the same orientation as the guides at about the middle position of each of the rod joints 20. Therefore a compact bundle of joints of sucker rod 20 may be bundled together for transportation from the place of assembly to the place where they will be used.

At the place of use the bundles 26 are broken apart and the joints 20 formed into the string 18. Also with the pin end of the bottom joint within the well which is attached to the pump 16 will be clear of a guide for about one half the length of a joint (about 10'). There will be no interference of a guide within 10' of the pump. Otherwise the guide 30 might form an obstruction of the reciprocation of the guide and sucker rod string 18 with the pump 16.

It will be understood that for each five sucker rods, one sucker rod will be the center sucker rod. Each outside rod will be nested in one of the flutes 32 of the center rod. The center rod will be nested in one of the flutes 30 of each outside rod.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. The method of putting a tubular rod guide on a sucker rod of a certain length between two sucker rod ends comprising the steps of:

a) telescoping the tubular guide over one of the ends of the rod, b) applying adhesive to the rod, then c) pushing the guide axially along the rod adhesive so that the adhesive fills an annular space between the rod and guide, and d) attaching a sucker rod end fitting to said end over which the guide was telescoped after the guide was telescoped.

2. The method as defined in claim 1 wherein said guide has two guide ends and a bore with a cylindrical section having two section ends between the guide ends, said section having a diameter forming a snug fit with the rod, and said section having a shoulder in the bore at one of the section ends and a taper in the bore at the other of the section ends further, comprising:

e) pushing the guide in the direction from the taper toward the shoulder thereby f) pushing adhesive ahead of the shoulder.

3. The method as defined in claim 2 further comprising:

g) telescoping two tubular guides on each of a plurality of sucker rods, then h) attaching a box sucker rod fitting on one end of each of the sucker rods and attaching a pin sucker rod fitting on the other end of the sucker rod, then i) applying adhesive in two places to each of the rods, then j) pushing each guide axially along the rod toward the box end sucker rod fitting and rotating each guide to a position of rotational alignment on the rod.

4. The method as defined in claim 3 further comprising:

k) attaching said sucker rods together to form a string, and l) running said string into a water well less than 200' deep.

5. A bundle of five sucker rod joints comprising:

a) each joint having two ends, b) a box fitting on one end of each sucker rod, c) a pin fitting on the other end of each sucker rod, d) a center sucker rod being in the center of said bundle, e) said center sucker rod having a guide near the box fitting, and a guide about half-way between the box fitting and the pin fitting,
f) two of the rods identified as mid-outside rods,
g) each of the mid-outside rods having two guides each guide adjacent to the guide on the center rod and spaced toward the pin fitting of the rod from the guide on the center rod,
h) two of said rods designated as bottom outside rods,
i) each bottom outside rod having two guides thereon,
j) each of said guides adjacent to the guides on the mid-outside rod and spaced toward the pin fitting from the mid-outside guides,
k) each of the guides having a fluted tubular body having an axis,
l) four axial guide bars on the outside of the body extending an equal distance from the axis,
m) a bore through the body,
n) one of said sucker rod joints extending through the bore,
o) a cylindrical section of the bore with a diameter whereby the section and sucker rod form a snug fit,
p) the section having a shoulder on one end and a taper on the other end,
q) said bore being tapered and flared from the shoulder to a flare end of each guide,
r) said bore having a guide end on each guide,
s) said flare end of each guide being closer to the box fitting of each rod than the guide end and the guide end of each guide being closer to the pin fitting of each rod than the flared end,
t) said bore at the flare end having a larger diameter than the bore at the guide end,
u) a flute between adjacent bars,
v) a hole through each bar parallel to said bore,
w) one of the outside sucker rods nested in each flute of the guide on the center sucker rod,
x) the center sucker rod nested in one of the flutes of a guide on each of the outside sucker rods,
y) the bars of the guides on each of said sucker rods rotationally aligned,
z) said sucker rods banded in a bundle,
aa) an annular space between the shoulder and the flare end of said guide and the sucker rod on which it is mounted, and
bb) said annular space filled with an adhesive.

6. A bundle of sucker rods comprising:
a) a fluted tubular sucker rod guide body having an axis,
b) axial guide bars on the outside of the body extending an equal distance from the axis, and
c) an axial bore through the body,
d) a cylindrical section of the bore with a diameter whereby the section and sucker rod form a snug fit,
e) the section having a shoulder on one end and a shoulder taper extending from the shoulder toward the end of the guide,
f) a center sucker rod and four outside sucker rods,
g) a guide as defined above attached on each sucker rod,
h) each guide having four of said bars with
i) a flute between adjacent bars,
j) one of said outside sucker rods nested in each flute of the guide on the center sucker rod,
k) the center sucker rod nested in one of the flutes on the guide on each of the outside sucker rods, and
l) said sucker rods banded into a bundle.

7. A guide to be attached to a sucker rod comprising:
a) a fluted tubular body having an axis,
b) axial guide bars on the outside of the body extending an equal distance from the axis, and
c) an axial bore through the body,
d) a cylindrical section of the bore with a diameter whereby the section and sucker rod form a snug fit,
e) the section having a shoulder on one end and a shoulder taper extending from the shoulder toward the end of the guide,
f) said bore being flared from the shoulder taper to a flare end of the guide,
g) a guide end on the guide opposite the flare end, and
h) the bore at the flare end having a larger diameter than the bore at the guide end.

8. The guide as defined in claim 7 further comprising:
i) a sucker rod with said guide thereon,
j) an annular space between the shoulder and the flare end, and
k) said annular space filled with an adhesive.

9. The structure as defined in claim 8 further comprising:
l) said sucker rod in a water well less than 200′ deep.

10. A guide attached to a sucker rod comprising:
a) a fluted tubular body having an axis,
b) axial guide bars on the outside of the body extending an equal distance from the axis, and
c) an axial bore through the body,
d) a cylindrical section of the bore with a diameter whereby the section and sucker rod form a snug fit,
e) the section having a shoulder on one end and a shoulder taper extending from the shoulder toward the end of the guide,
f) a sucker rod with said guide thereon,
g) an annular space between the shoulder taper of the guide and the sucker rod,
h) said annular space filled with an adhesive.

11. The guide as defined in claim 10 in combination with additional structure comprising:
f) a sucker rod with two guides as defined above attached thereto.

12. The guide as defined in claim 11 further comprising:
g) the bars of the guides rotationally aligned on said sucker rod.

13. The structure as defined in claim 12 further comprising:
h) said sucker rod in a water well less than 200′ deep.

* * * * *